US005826649A

United States Patent [19]

Chapp et al.

[11] Patent Number: 5,826,649

[45] Date of Patent: Oct. 27, 1998

[54] EVAPORATOR, CONDENSER FOR A HEAT PUMP

[75] Inventors: Terry L. Chapp, New Berlin; C. James Rogers; William Markusen, both of Racine, all of Wis.

[73] Assignee: Modine Manufacturing Co., Racine, Wis.

[21] Appl. No.: 788,525

[22] Filed: Jan. 24, 1997

[51] Int. Cl.[6] ..... F28F 9/26

[52] U.S. Cl. ..... 165/174; 165/175; 165/110; 165/144

[58] Field of Search ..... 165/174, 144, 165/110, 175, 104.21; 137/572, 571

[56] References Cited

U.S. PATENT DOCUMENTS

| | | | |
|---|---|---|---|
| 3,368,617 | 2/1968 | Rosman et al. | 165/175 |
| 3,372,738 | 3/1968 | Jan et al. | 165/175 |
| 3,404,731 | 10/1968 | Cushman | 165/175 |
| 3,416,600 | 12/1968 | Fink | 165/175 |
| 3,450,197 | 6/1969 | Fieni | 165/174 |
| 3,989,103 | 11/1976 | Cieszko et al. | 165/110 |
| 5,095,972 | 3/1992 | Nakaguro | 165/175 X |
| 5,157,944 | 10/1992 | Hughes et al. | 165/144 X |
| 5,341,870 | 8/1994 | Hughes et al. | 165/110 |
| 5,695,004 | 12/1997 | Rockwith | 165/104.21 |

FOREIGN PATENT DOCUMENTS

| | | | |
|---|---|---|---|
| 0068494 | 3/1990 | Japan | 165/174 |

*Primary Examiner*—Ira S. Lazarus
*Assistant Examiner*—Christopher Atkinson
*Attorney, Agent, or Firm*—Wood, Phillips, VanSanten, Clark & Mortimer

[57] ABSTRACT

Improved condensate drainage is achieved while compact size is retained in a condenser/evaporator for use in a heat pump system in a construction having first and second, curved, generally congruent tubular headers (10), (14) with one of the headers (10) being an upper header and the other of the headers (14) being a lower header. A first row of elongated tube slots (18) is located in the upper header (10) while a second row of elongated tube slots (20) is located in the lower header (14). Each tube slot (18) in the first row has a corresponding tube slot (20) in the second row and corresponding tube slots (18), (20) in the rows are aligned with one another. Elongated, straight, flattened tubes (22) extend between the headers (10), (14), in parallel with each other and a first port (32) is provided for refrigerant in one of the headers (10) and a second port (36) is provided for refrigerant in the other of the headers (14).

14 Claims, 3 Drawing Sheets

EVAPORATOR, CONDENSER FOR A HEAT PUMP

FIELD OF THE INVENTION

This invention relates to heat exchangers, and more particularly, to a heat exchanger that may serve as an outdoor coil and operate as both an evaporator and a condenser in a heat pump system.

BACKGROUND OF THE INVENTION

The use of heat pumps for both heating and cooling is increasing. Such systems are readily usable in climates that do not experience severe cold and are even employed in such climates where some other back-up heating system is utilized. As is well known, heat pump systems include an interior heat exchanger that is disposed within the building to be heated or cooled as well as an exterior heat exchanger that is located on the exterior of the building. Depending upon whether the system is performing a cooling or a heating operation, one heat exchanger will be used as an evaporator while the other will be employed as a condenser, and vice versa.

In the case of the heat exchanger used exteriorally of the building, when the same is operating as an evaporator, condensate will typically form on the surfaces of the heat exchanger. Provision must be made to assure that such condensate drains rapidly from the surfaces of the heat exchanger or else reduced efficiency results as a consequence of the requirement that heat be rejected through a layer of condensate, sometimes in the form of ice, rather than directly from the ambient air to the surface of the heat exchanger itself.

Recent advances in heat exchanger construction have resulted in a whole generation of so-called "parallel flow" heat exchangers. In these heat exchangers, in lieu of conventional headers with separate tanks, tubular header and tank assemblies are frequently used. Alternatively, laminated header and tank assemblies may also be used. A plurality of tubes, typically flattened tubes, extend between opposed headers and fins are located between adjacent ones of the tubes.

While heat exchangers of this sort exhibit many improved characteristics over prior art heat exchangers, when used as evaporators, drainage of condensate formed on tubes and fins is of great concern.

Furthermore, because the refrigerant used in such systems will be flowing in several hydraulically parallel paths simultaneously, some care must be taken to provide uniform distribution of the refrigerant through such paths, particularly when the heat exchanger is functioning as an evaporator, if loss of efficiency is to be avoided.

The present invention is directed to overcoming one or more of the above problems.

SUMMARY OF THE INVENTION

It is the principal object of the invention to provide a new and improved heat exchanger. More particularly, it is an object of the invention to provide a new and improved condenser/evaporator for use in heat pump systems.

An exemplary embodiment of the invention achieves the foregoing object in a condenser/evaporator including first and second, curved, generally congruent tubular headers. One of the headers is an upper header and the other of the headers is vertically spaced below but aligned with the upper header to define a lower header. A first row of elongated tube slots is disposed in the upper header. The slots open downwardly toward the lower header. A second row of elongated tube slots is formed in the lower header. The slots open upwardly toward the upper header. Each tube slot in the first row has a corresponding tube slot in the second row and corresponding tube slots in the rows are aligned with one another. Elongated, straight, flattened tubes extend between the headers in parallel with each other. The tubes have first ends received in corresponding slots in the first row and second, opposite ends, received in corresponding slots in the second row. A first port is provided for refrigerant in one of the headers and a second port for a refrigerant is provided in one of the headers.

By using straight, elongated tubes which are arranged vertically, excellent draining of condensate is achieved. Further, by providing at least one curve in the headers, compactness is also achieved.

In a highly preferred embodiment, the invention further includes first and second flow restrictions in the first and second headers respectively. The first port is in the first header and the second port is in the second header and a jumper tube interconnects the headers from a location on the first header on the side of the first flow restriction remote from the first port to a location on the second header on the side of the second flow restriction remote from the second port.

In one embodiment, one or more of the flow restrictions are baffles. In another embodiment, at least one of the flow restrictions is a one-way valve.

Other objects and advantages will become apparent from the following specification taken in connection with the accompanying drawings.

DESCRIPTION OF THE PREFERRED EMBODIMENTS

Figure 1:
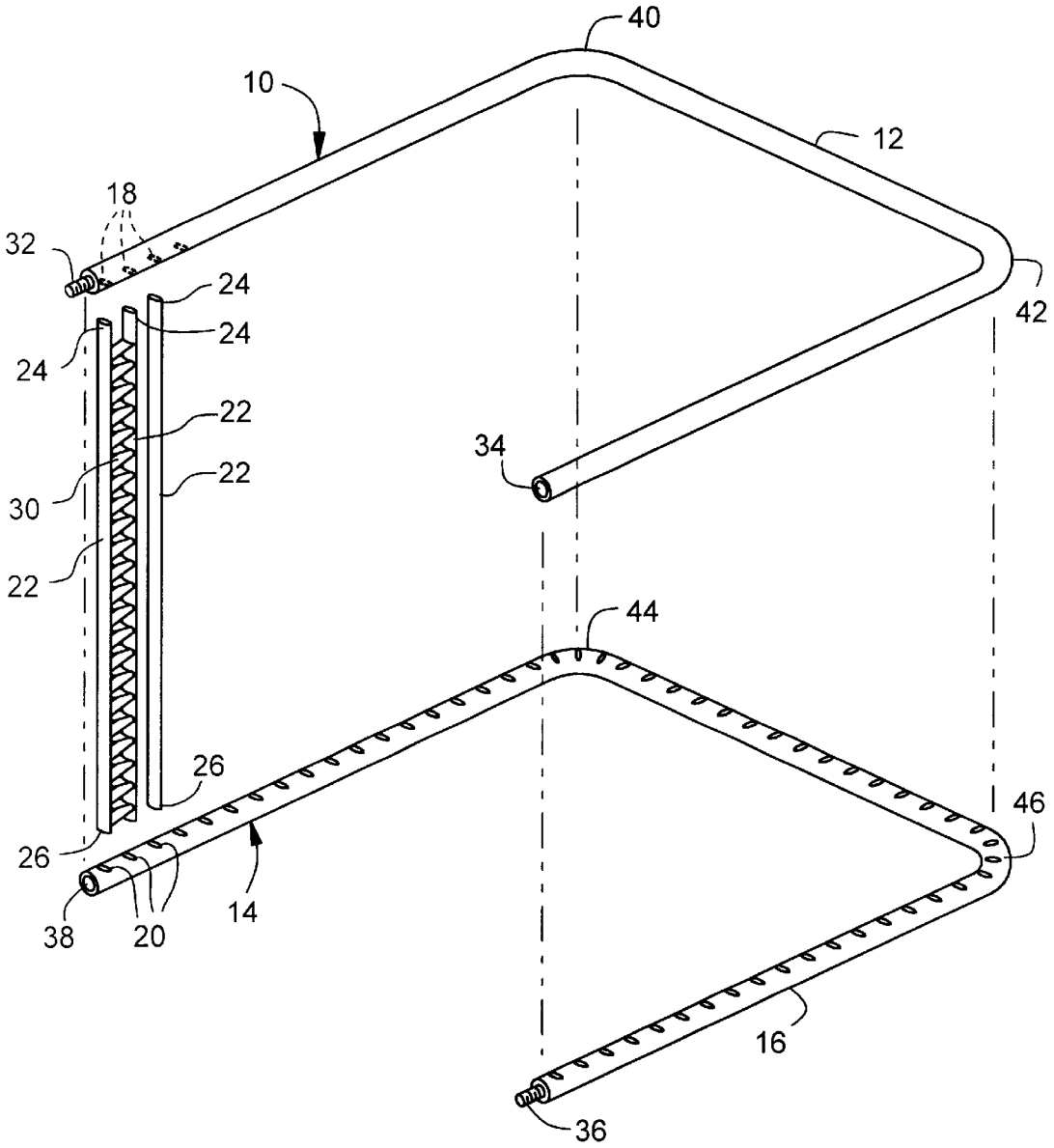
FIG. 1 is an exploded view of one form of condenser/evaporator made according to the invention.

Exemplary embodiments of condenser/evaporators are illustrated in the drawings. Such condenser/evaporators will typically be parallel flow type heat exchangers, although multipassing is specifically contemplated.

With reference to FIG. 1, a first header and tank assembly is generally designated 10 and is formed of a tube 12 bent in the form of a U. A lower header and tank assembly, generally designated 14, includes a similar tube 16, also bent in the form of a U. Preferably, the tubes 12 and 16 are generally congruent in the geometric sense and are aligned with one another with the first header 10 being an upper header and the header 14 being vertically spaced below the upper header 10 to define a lower header.

The upper header 10 includes a row of tube slots 18 which are elongated and which open downwardly to face the lower header 14. The lower header 14 also has a row of tube slots 20 which are also elongated and which open upwardly to face the upper header 10. The tube slots 18 in the upper header 10 each have a counterpart in the tube slots 20 in the lower header 14 and corresponding ones of the tube slots 18 and 20 are aligned. Elongated, flattened tubes 22 have upper ends 24 which are received in the tube slots 18 and sealed thereto as, for example, by brazing. The opposite ends 26 of the flattened tubes 22 are received in the tube slots 20 and sealed thereto, again, as by brazing. As a consequence, the tubes 22 are parallel to each other, both in the geometric and in the hydraulic sense. Preferably, serpentine fins 30 (only one of which is shown in FIG. 1) are located between adjacent ones of the tubes 22 and are brazed thereto.

At one end, the header 10 includes a port 32. The opposite end is capped as at 34.

The header 14 includes a port 36 at one end. A cap 38 similar to the cap 34 closes off the other end.

It has been found that when the heat exchanger just described is being operated as an evaporator in a heat exchange system, improved efficiency is obtained if the refrigerant to be evaporated, already in two phase flow, is introduced into the lower header 14. This acts to improve distribution of the refrigerant to promote more uniform flow through the various ones of the tubes 22. Thus, the port 36 will be used as an inlet during an evaporation operation as an outlet during a condensation operation. Similarly, the port 32 will be used as an outlet during an evaporation operation and will be used as an inlet during a condensation operation.

In the usual case, the heat exchanger shown in FIG. 1 will be formed in a single plane using conventional techniques. The curves 40 and 42 in the upper header 10 and 44 and 46 in the lower header 14 may be formed after the various components have been brazed together using the bending equipment disclosed in commonly assigned U.S. Pat. No. 5,341,870 issued Aug. 30, 1994, to Hughes et al. The entire disclosure of the Hughes et al. patent is herein incorporated by reference.

This allows the condenser/evaporator to be formed in any of a variety of desired shapes from a basically rectangular solid shape as shown in FIG. 1 to a virtually completely circular shape (not shown) if desired. As a consequence, the envelope of the heat exchange unit of which the condenser/evaporator is part may be made very compact.

Even more importantly, the arrangement of the headers 10 and 14 with vertical, elongated, flattened tubes 22 allows this compactness to be achieved at the same time as vertical orientation of the tubes 22 provides excellent drainage of condensate when the condenser/evaporator is being operated as an evaporator. Thus, through the unique use of curved upper and lower headers, excellent condensate drainage is obtained while the highly desirable feature of compact construction is retained.

Figure 2:
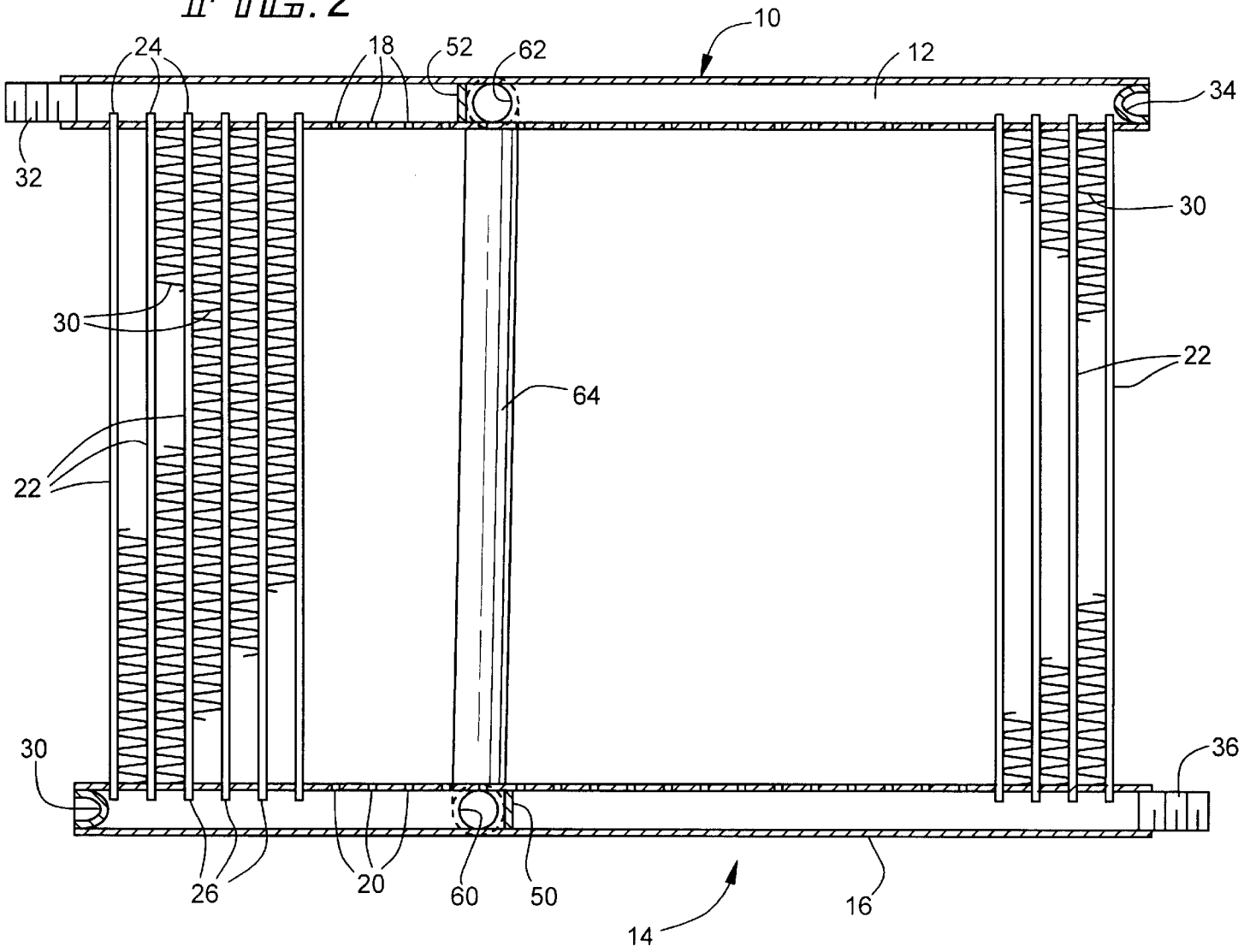
FIG. 2 is a somewhat schematic, vertical section of a modified embodiment of the evaporator/condenser.
Figure 3:
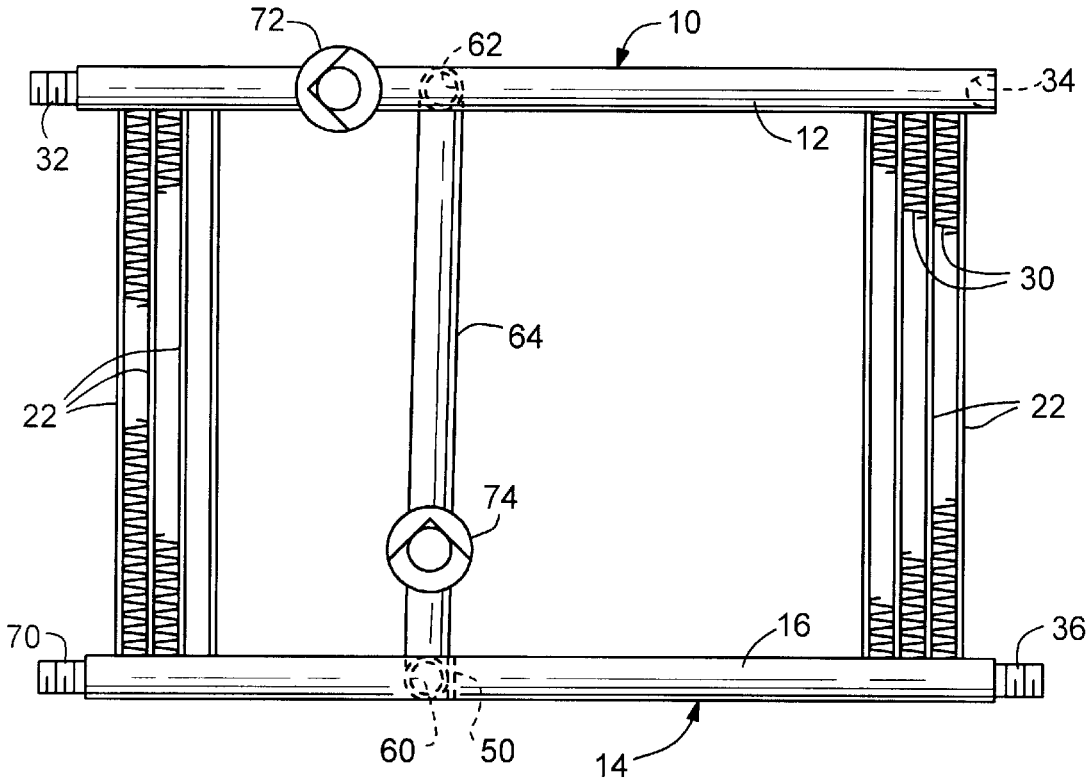
FIG. 3 is a schematic elevation of another embodiment of an evaporator/condenser, with valves employed therein shown in an exaggerated fashion.

FIG. 2 illustrates a modified form of the condenser/evaporator. Still another modified embodiment is illustrated in FIG. 3 and while both figures appear to show the condenser/evaporator in a planar form, it is to be expressly understood that preferred embodiments of the heat exchanger shown in FIGS. 2 and 3 will have curved headers just as the embodiment of FIG. 1.

With that understanding in mind, the embodiment illustrated in FIG. 2 will be described and where like components are used, like reference numerals will be employed.

The embodiment illustrated in FIG. 2 is a multi-pass embodiment and in particular, a two pass embodiment. For any given heat exchanger having the geometry of the type herein disclosed, multiple passes increase the velocity of the refrigerant flowing with the heat exchanger. As is known, increased velocities increase the rate of heat transfer. Thus, multiple passes allow the selection of optimum flow rates to achieve the best efficiency. To achieve a multi-pass geometry, the FIG. 2 embodiment includes a flow restriction 50 in the form of a baffle. The baffle 50 is brazed in place within the tube 16 forming the lower header. A similar baffle 52 is brazed in place within the tube 12 forming the upper header 10.

To the side of the baffle 50 remote from the port 36 is an opening 60 to the interior of the lower header 14. A similar opening 62 is provided in the upper header 10 and is located on the side of the baffle 52 remote from the port 32. A jumper tube 64 having approximately the same inside diameter as the tubes 12 and 16, and considerably greater than the cross-sectional area of the flow paths within the tubes 22, interconnects the openings 60 and 62. It will thus be appreciated that the flow path through the embodiment illustrated in FIG. 2 extends from the port 32 through that part of the upper header 10 that is to the left of the baffle 52 and through the flattened, elongated tubes 22 to that part of the lower header 14 that is to the left of the baffle 50. From there, the fluid flow path goes through the jumper tube 64 back to the upper header 10 and that part thereof that is to the right of the baffle 52. It continues through the tubes 22 to return to the lower header 14 at a location thereon to the right of the baffle 50. From there, the flow path extends to the port 36.

While no particular advantage is ascribed to this flow path when the heat exchanger is operating as a condenser, a substantial advantage accrues when the same is operating as an evaporator in a heat pump system.

It will be recalled from the discussion of the embodiment of FIG. 1 that more uniform distribution of the refrigerant to be evaporated is achieved if it is introduced into the lower header 14, and that improved efficiency results. Consequently, again, the port 36 may be used as an inlet for refrigerant when the heat exchanger is operating as an evaporator. Because of this use of the port 36, relatively uniform distribution of the refrigerant on the right hand side of the baffle 50 will occur and good efficiency of evaporation will be obtained as the same flows upwardly through the tubes 22 to the upper header 10. Once collected there, the refrigerant, some of which will still be in liquid form, is returned to the lower header by the jumper tube 64 and will then again flow upwardly through the tubes 22 on the left hand side of the baffle 50. Again, because the refrigerant is introduced to the lower header 14 prior to beginning its second pass through the heat exchanger, a more uniform distribution and, therefore, a more efficient evaporation cycle will be obtained. Thus, the invention illustrated in FIG. 2 provides a means of obtaining the uniform distribution of the refrigerant during an evaporation operation in a multiple pass arrangement through the use of the jumper tube 64 returning the refrigerant to the lower header before it makes it's second pass. Of course, if more than two passes were desired, additional jumper tubes could be used, one for each additional pass. This assures that the more uniform distribution of the refrigerant achieved by placing it in a lower header occurs with each pass.

FIG. 3 illustrates still another embodiment of the invention which also takes advantage of the more uniform distribution of refrigerant during an evaporation operation that can be obtained by introducing the refrigerant into the lower header of a vertically arranged heat exchanger. Again, where like components are used, like reference numerals will be used. In the embodiment illustrated in FIG. 3, the plug 38 is dispensed with in favor of an additional port 70. Further, the baffle 52 is dispensed with in favor of a one-way valve 72 fitted within the tube 12 forming the upper header at a location immediately adjacent the opening 62 and on the side thereof closest to the port 32. It is to be specifically understood that the size of the one-way valve 72 as shown in FIG. 3 is exaggerated.

The one-way valve is oriented so as to allow flow to proceed from that part of the upper header 10 to the left of the valve 72 toward the right hand side of the upper header 10, but not the reverse.

A similar one-way valve 74 is disposed within the jumper tube 64 in close proximity to its point of connection to the lower header 14. The one-way valve 74 allows downward flow within the jumper tube 64 but not the reverse.

In the embodiment illustrated in FIG. 3, the port 32 serves as an outlet only during an evaporator operation and performs no other function. However, the port 36 continues to serve as an inlet during an evaporation operation and as an outlet during a condensation operation. The additional port 70 is used only as an inlet and only during the condensation operation. Thus, during an evaporation operation, the embodiment of FIG. 3 will operate just as the embodiment illustrated in FIG. 2 because the one-way valve 74 will allow flow of the refrigerant from the upper header 10 to the lower header 14 through the jumper tube 64. At the same time, the one-way valve 72 will prevent flow from the right hand side of the header 10 directly to the port 32 which is serving as an outlet at this time.

On the other hand, when the embodiment of FIG. 3 is operating as a condenser, the refrigerant to be condensed is introduced through the inlet 70 and will flow through the tubes 22 upwardly to the upper header 10 and the left hand side thereof. From there it will flow through the one-way valve 72 to the right hand side of the upper header 10 and then pass downwardly through the tubes 22 and ultimately to the port 36 which is now serving as an outlet. The jumper tube 64 cannot act as a bypass because the one-way valve 74 prevents upward flow of refrigerant within the jumper tube 64.

It will therefore be appreciated that heat exchangers intended as condensers/evaporators for use in heat pump systems and made according to the invention possess several advantages. For one, they may be configured in relatively small envelopes to achieve compactness of system units in which they are received. At the same time, the vertical orientation of the tubes 22 assures excellent condensate drainage when the same are operating as evaporators. Moreover, the use of the jumper tubes 64 and flow restrictions either in the form of the baffles 50 and 52 or the one-way valves 72 and 74 provide a means whereby the heat exchanger possesses multiple passes to achieve optimum flow velocities. At the same time uniform distribution of the refrigerant when the heat exchanger is operating as an evaporator is achieved to maximize evaporation cycle efficiency. This is accomplished through the unique circuiting of the apparatus which assures that the refrigerant is always introduced into the lower header for each pass during an evaporation operation.

Finally, it is believed self-evident that though the invention has been described in the context of a heat exchanger used interchangeably as an evaporator and as a condenser, the invention may be used with efficacy in a heat exchanger used solely as an evaporator.

We claim:

1. A heat exchanger intended for at least partial use as an evaporator comprising:

an upper header and tank assembly having a plurality of downwardly opening tube slots;

a lower header and tank assembly located below and spaced from said upper header and tank assembly and having a plurality of upwardly opening tube slots;

tube slots in said upper header and tank assembly being aligned with corresponding tube slots in said lower header and tank assembly;

elongated tubes extending vertically between said header and tank assemblies and having tube ends received in respective ones of said slots and being sealed to the associated header and tank assembly thereat;

a first port in said lower header and tank assembly and adapted to serve as an inlet during an evaporation operation and as an outlet during a condensing operation, a second port in said upper header and tank assembly and spaced laterally along said upper header and tank assembly from said first port and adapted to at least serve as an outlet during an evaporation operation;

a jumper tube having an internal flow path substantially larger than that of said elongated tubes and located between said first and second ports and connected to said lower header and tank assembly at a first location spaced from both said ports and connected to said upper header and tank assembly; at a second location spaced from both said ports;

means, including a first flow restriction in said lower header and tank assembly, for preventing fluid flow through said lower header and tank assembly from said first port to said jumper tube at said first location; and means including a second flow restriction in said upper header and tank construction between said second port and said second location for preventing flow in said upper header and tank assembly from said second location to said second port;

whereby during an evaporation operation, fluid to be evaporated will flow into said lower header and tank assembly through some of said elongated tubes and then through said upper header and tank assembly at said second location and then be returned to said lower header and tank assembly by said jumper tube to flow from said lower header and tank assembly through others of said elongated tubes to said upper header and tank assembly and then to said second port to achieve more uniform distribution of said fluid to thereby increase the efficiency of the evaporation operation.

2. The heat exchanger of claim 1 wherein at least one of said flow restrictions is a baffle.

3. The heat exchanger of claim 1 wherein at least one of said flow restriction is a one-way valve.

4. The heat exchanger of claim 1 wherein one of said flow restrictions is a baffle and another of said flow restrictions is a one-way valve.

5. The heat exchanger of claim 1 wherein said first flow restriction is a baffle and said second flow restriction is a one-way valve.

6. The heat exchanger of claim 5 further including a further one-way valve in said jumper tube and disposed to allow flow from said second location to said first location but not the reverse.

7. The heat exchanger of claim 6 particularly adapted for use in a heat pump system to alternatively perform an evaporation operation and a condensing operation and further including a third port connected to said lower header and tank assembly on a side of said baffle opposite said first port, said third port adapted to serve as a fluid inlet during a condensing operation.

8. The heat exchanger of claim 1 wherein said second flow restriction is a baffle.

9. The heat exchanger of claim 8 wherein said first flow restriction is a baffle.

10. The heat exchanger of claim 1 wherein both said flow restrictions are baffles.

11. The heat exchanger of claim 1 wherein said elongated tubes are straight and said header and tank assemblies are curved and generally congruent with each other.

12. A heat exchanger comprising:

first and second curved, generally congruent tubular headers;

one of said headers being an upper header;

the other of said headers being vertically spaced below but aligned with said upper header and defining a lower header;

a first row of elongated tube slots in said upper header and opening downwardly toward said lower header;

a second row of elongated tube slots in said lower header and opening upwardly toward said upper header;

each tube slot in said first row having a corresponding tube slot in said second row;

corresponding tube slots in said rows being aligned with one another;

elongated, straight, flattened tubes extending between said headers in parallel with each other;

said tubes each having first ends received in corresponding slots in said first row;

said tubes having second ends opposite said first ends and received in corresponding slots in said second row, a first port for refrigerant in one of said headers;

a second port for refrigerant in one of said headers:

first and second flow restrictions in said first and second headers respectively;

said first port being in said first header and said second port being in said second header; and a jumper tube interconnecting said headers from a location on said first header on the side of said first flow restriction remote from said first port to a location on said second header on the side of said second flow restriction remote from said second port.

13. A heat exchanger comprising:

an upper header and tank assembly having a plurality of downwardly opening tube slots;

a lower header and tank assembly located below and spaced from said upper header and tank assembly and having a plurality of upwardly opening tube slots;

tube slots in said upper header and tank assembly being aligned with corresponding tube slots in said lower header and tank assembly;

elongated tubes extending vertically between said header and tank assemblies and having tube ends received in respective ones of said slots and being sealed to the associated header and tank assembly thereat;

a first port in said lower header and tank assembly and adapted to serve as an inlet during an evaporation operation and as an outlet during a condensing operation;

a second port in said upper header and tank assembly and spaced laterally along said upper header and tank assembly from said first port and adapted to at least serve as an outlet during an evaporation operation;

a jumper tube having an internal flow path substantially larger than that of said elongated tubes and located between said first and second ports and connected to said lower header and tank assembly at a first location spaced from both said ports and connected to said upper header and tank assembly at a second location spaced from both said ports;

a first baffle in said lower header and tank assembly for preventing fluid flow through said lower header and tank assembly from said first port to said jumper tube at said first location; and means including a second flow restriction in said upper header and tank construction between said second port and said second location for preventing flow in said upper header and tank assembly from said second location to said second port;

whereby during an evaporation operation, fluid to be evaporated will flow into said lower header and tank assembly through some of said elongated tubes and then through said upper header and tank assembly at said second location and then be returned to said lower header and tank assembly by said jumper tube to flow from said lower header and tank assembly through others of said elongated tubes to said upper header and tank assembly and then to said second port to achieve more uniform distribution of said fluid to thereby increase the efficiency of the evaporation operation.

14. A heat exchanger comprising:

an upper header and tank assembly having a plurality of downwardly opening tube slots;

a lower header and tank assembly located below and spaced from said upper header and tank assembly and having a plurality of upwardly opening tube slots;

tube slots in said upper header and tank assembly being aligned with corresponding tube slots in said lower header and tank assembly;

elongated tubes extending vertically between said header and tank assemblies and having tube ends received in respective ones of said slots and being sealed to the associated header and tank assembly thereat;

a first port in said lower header and tank assembly and adapted to serve as an inlet during an evaporation operation and as an outlet during a condensing operation;

a second port in said upper header and tank assembly and spaced laterally along said upper header and tank assembly from said first port and adapted to at least serve as an outlet during an evaporation operation;

a jumper tube having an internal flow path substantially larger than that of said elongated tubes and located between said first and second ports and connected to said lower header and tank assembly at a first location spaced from both said ports and connected to said upper header and tank assembly at a second location spaced from both said ports;

a baffle in said lower header and tank assembly, for preventing fluid flow through said lower header and tank assembly from said first port to said jumper tube at said first location;

means including a first one-way valve in said upper header and tank construction between said second port and said second location for preventing flow in said upper header and tank assembly from said second location to said second port; and a second one-way valve in said jumper tube for allowing flow from said second location to said first location but not the reverse;

whereby during an evaporation operation, fluid to be evaporated will flow into said lower header and tank assembly through some of said elongated tubes and then through said upper header and tank assembly at said second location and then be returned to said lower header and tank assembly by said jumper tube to flow from said lower header and tank assembly through others of said elongated tubes to said upper header and tank assembly and then to said second port to achieve more uniform distribution of said fluid to thereby increase the efficiency of the evaporation operation.

* * * * *